US007336148B2

(12) United States Patent
Lai

(10) Patent No.: US 7,336,148 B2
(45) Date of Patent: Feb. 26, 2008

(54) STRUCTURE OF INDUCTOR

(75) Inventor: Yuan-Ho Lai, Hukou Township, Hsinchu County (TW)

(73) Assignee: Chilisin Electronics Corp., Hsinchu County (TW)

( * ) Notice: Subject to any disclaimer, the term of this patent is extended or adjusted under 35 U.S.C. 154(b) by 0 days.

(21) Appl. No.: 11/305,002

(22) Filed: Dec. 19, 2005

(65) Prior Publication Data

US 2007/0139153 A1 Jun. 21, 2007

(51) Int. Cl.
*H01F 27/24* (2006.01)

(52) U.S. Cl. ..... 336/212; 336/221

(58) Field of Classification Search ..... 336/221, 336/212, 233, 83
See application file for complete search history.

(56) References Cited

U.S. PATENT DOCUMENTS 5,117,215 A * 5/1992 Kakehashi et al. ..... 336/178
6,351,203 B1 * 2/2002 Mihara et al. ..... 336/90
6,680,664 B2 * 1/2004 Fan ..... 336/83
2005/0248426 A1 * 11/2005 Lin ..... 336/83

* cited by examiner

*Primary Examiner*—Anh Mai
(74) *Attorney, Agent, or Firm*—Alan Kamrath; Kamrath & Associates PA

(57) ABSTRACT

An improved structure of inductor includes a C-shaped core and a prismatic strut core. The C-shaped core has two extended portions and a side portion that has its two ends connected to a fixed end of each of the extended portions. The prismatic strut core has a bottom surface, a top surface, and a number of side surfaces that are wound around by a coil. The prismatic strut core inserts and places between the two extended portions with the coil pressed against the side portion. When it comes to assembling, all one has to do is to place the prismatic strut core into the C-shaped core and has adhesive to glue the coil to the side portion to complete the fabrication of the inductor in order to prevent the coil from being loose and come off.

4 Claims, 5 Drawing Sheets

STRUCTURE OF INDUCTOR

BACKGROUND OF THE INVENTION

1. Field of the Invention

The invention relates to an improved structure of inductor, and more particularly, to an improved structure of inductor that has low "electromagnetic-wave interference" (EMI) and is convenient to be assembled.

2. Description of the Prior Art

As shown in FIG. 1 through FIG. 3, the conventional inductance core structure mainly includes 2 components, an H-shaped core (5) and a core sheet (6). The H-shaped core (5) is equipped with an extended salient portion (51) at the two ends thereof to make a bobbin (52) formed between the two extended salient portions (51) for the winding of a coil (3). When it comes to assembling, one can put the H-shaped core (5) in horizontal position and braze the coil (3) to secure at a predetermined position on a circuit board (8) and in the meantime bond the core sheet (6) to the top of the H-shaped core (5) by the use of adhesive (7). In this way, by making use of the core sheet (6) to accommodate the circuit board (8), a covered shield is formed at the top and bottom sides of the coil (3). However, when it comes to application, this kind of assembled structure has the following disadvantage:

1. The paint-coated wire of the coil (3) winds directly around the bobbin (52) of the H-shaped core (5), and since it is very inconvenient to hold the H-shaped core (5) in position, it is not easy to improve the efficiency of production.
2. Two gaps are formed between the two extended salient portions (51) of the H-shaped core (5) and the core sheet (6). Those gaps that are positioned at the two side portions where the H-shaped core (5) and core sheet (6) are bonded will generate magnetic flux leakage that is apt to diffuse outward to cause electromagnetic-wave interference (EMI) with respect to the peripheral components.
3. Since the paint-coated wire of the coil (3) winds directly around the bobbin (52) of the H-shaped core (5), when it comes to winding the wire, the paint-coated surface of the external layer of the wire or the surface of the H-shaped core (5) is liable to wear out. This will affect the insulation or other electrical characteristics.

SUMMARY OF THE INVENTION

In light of the above-mentioned disadvantages of the prior arts, the invention aims to ameliorate at least some of the disadvantages of the prior art or to provide a useful alternative.

The primary objective of the invention is to provide an improved structure of inductor whose coil can wind around a prismatic strut core beforehand, then assemble it with the C-shaped core in order to provide an effective and simplified fabrication process to achieve the efficacy of improving the production efficiency.

The secondary objective of the invention is to provide an improved structure of inductor whose prismatic strut core is equipped at each of the two adjacent side surfaces with a plurality of chamfers that is capable of preventing the paint-coated wire and the surface of the cores from being scrapped and damaged.

The further objective of the invention is to provide an improved structure of inductor whose C-shaped core is made by integrated forming to lower the electromagnetic-wave interference (EMI) in order to achieve the efficacy of improving the electrical characteristics of the product.

To achieve the above-mentioned objectives, the invention provides an improved structure of inductor that includes a C-shaped core and a prismatic strut core. The C-shaped core has two extended portions and a side portion that has its two ends connected to a fixed end of each of the extended portions. The prismatic strut core has a bottom surface, a top surface, and a number of side surfaces that are wound around by a coil. The prismatic strut core inserts and places between the two extended portions with the coil pressed against the side portion. When it comes to assembling, all one has to do is to place the prismatic strut core into the C-shaped core and has adhesive to glue the coil to the side portion to complete the fabrication of the inductor in order to prevent the coil from being loose and come off.

The accomplishment of this and other objectives of the invention will become apparent from the following description and its accompanying drawings of which:

DETAILED DESCRIPTION OF THE PREFERRED EMBODIMENT

Figure 1:
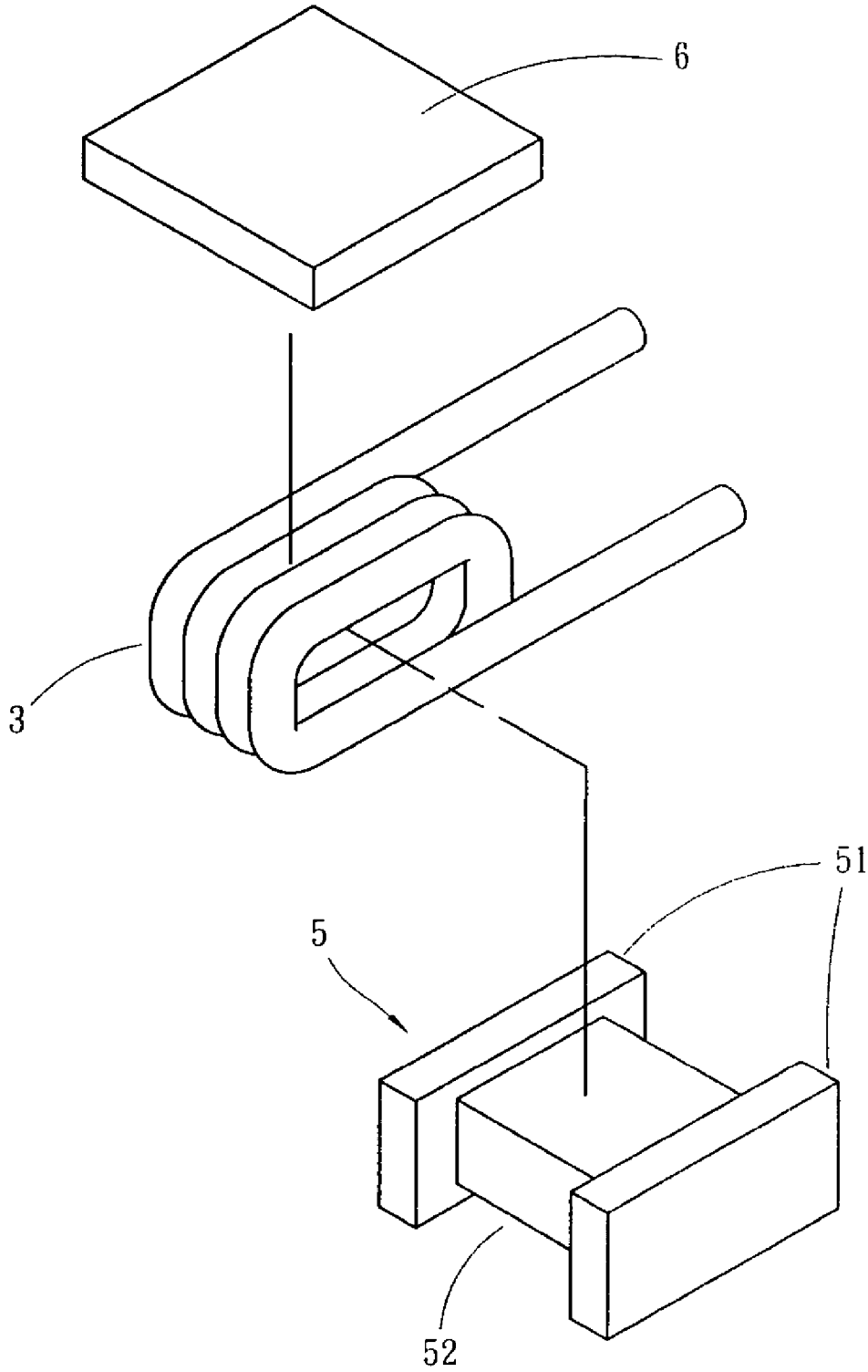
FIG. 1 PRIOR ART
FIG. 1 is an exploded view of the inductance core structure of the prior art.
Figure 2:
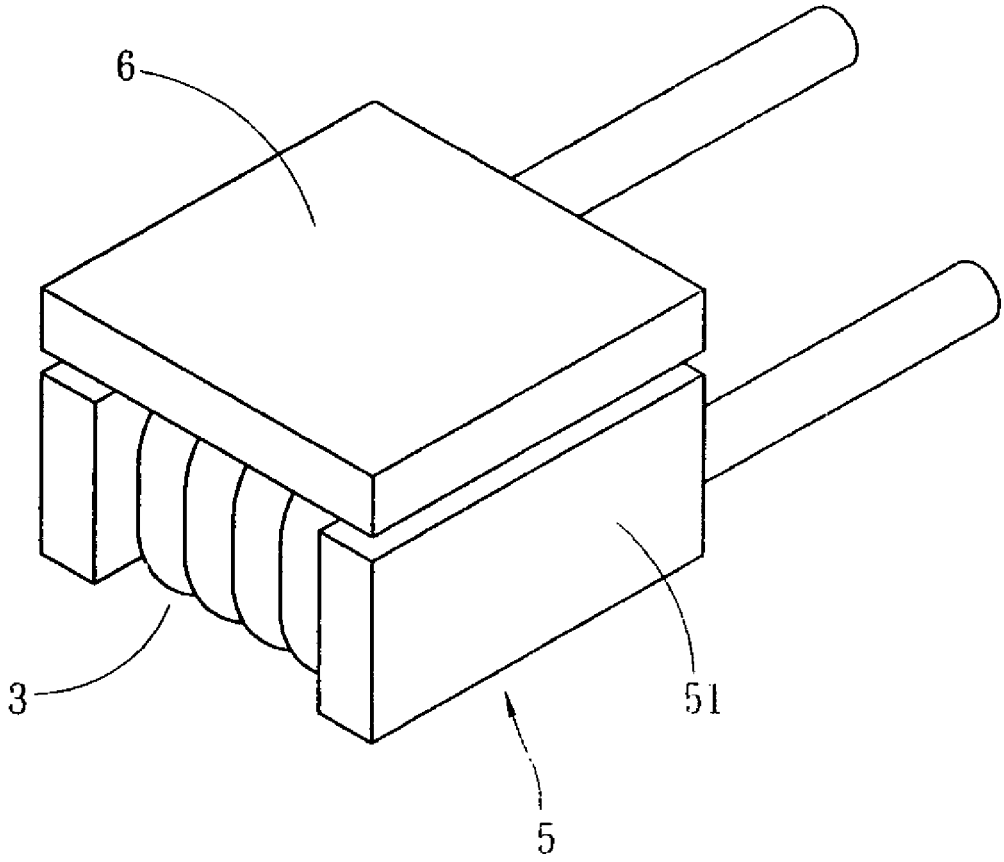
FIG. 2 PRIOR ART
FIG. 2 is an isometric view showing the outward appearance of the assembled inductance core structure of the prior art.
Figure 3:
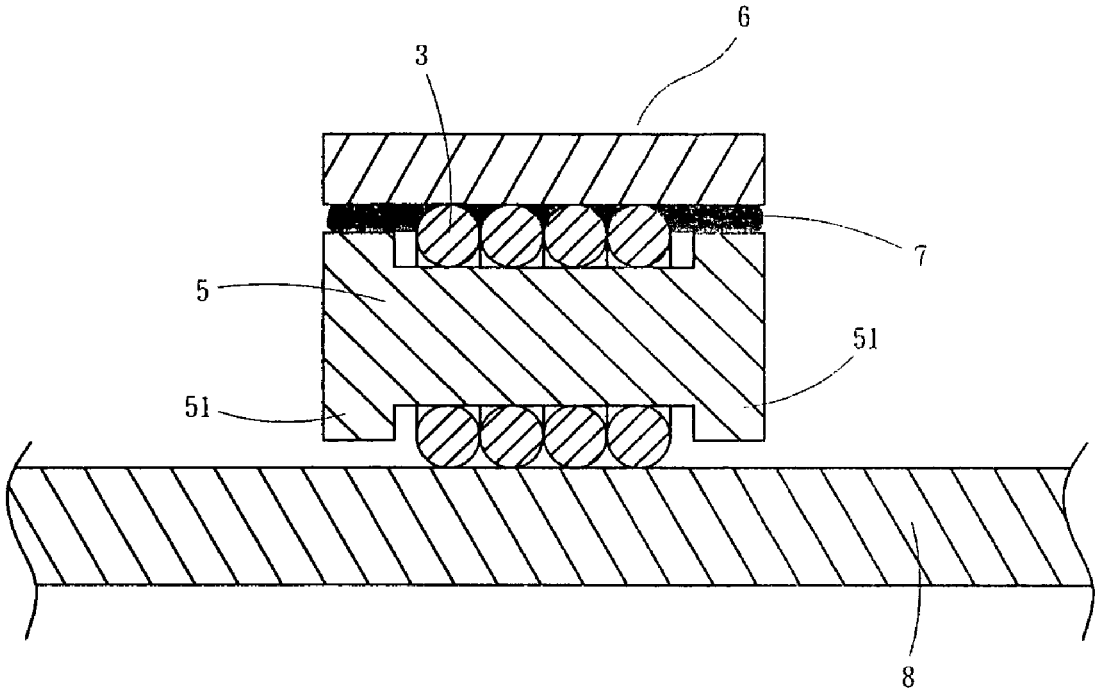
FIG. 3 PRIOR ART
FIG. 3 is an assembled cross-sectional view of the inductance core structure of the prior art.
Figure 4:
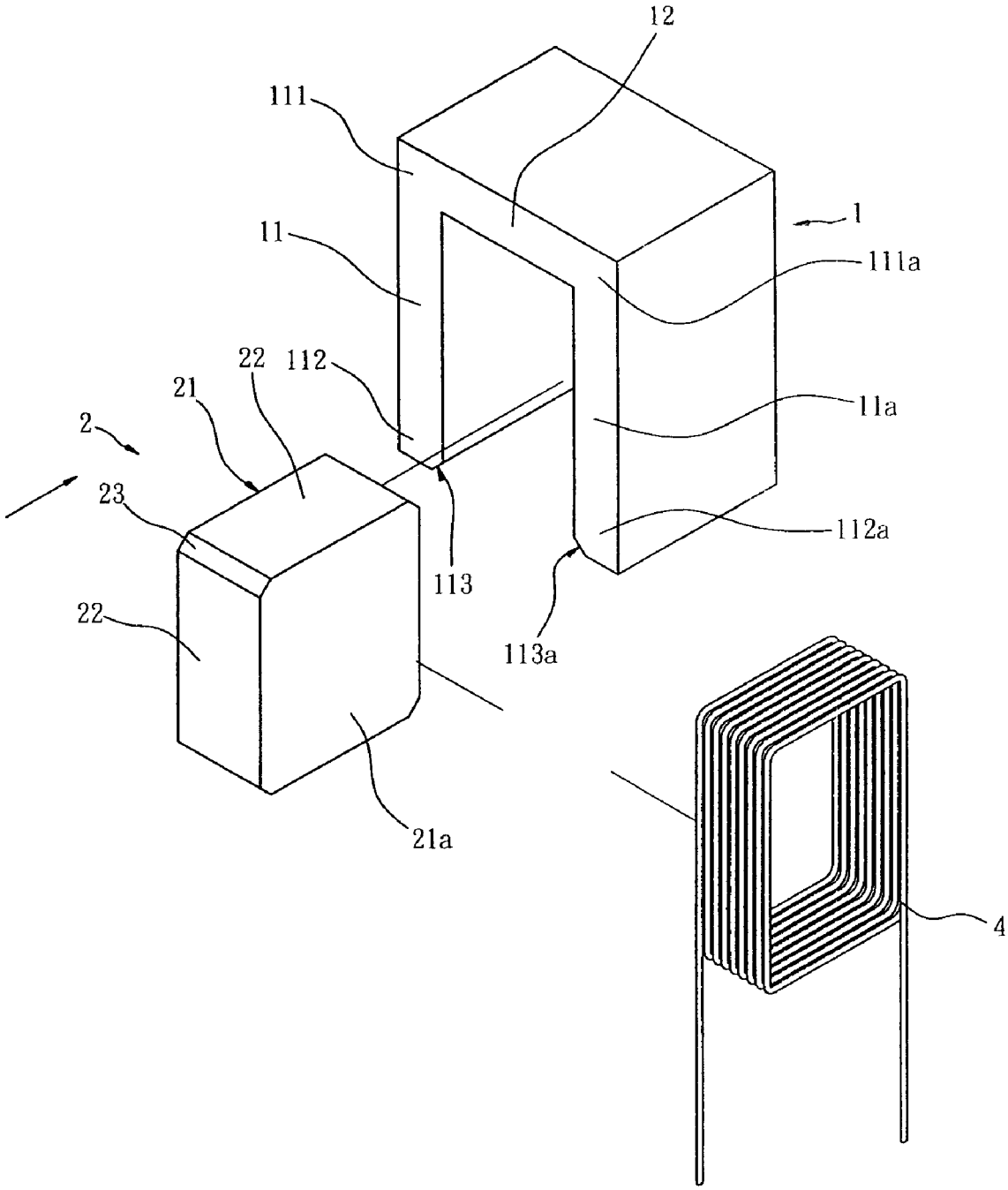
FIG. 4 is a schematic exploded view of the improved structure of inductor of the preferred embodiment of the invention.
Figure 5:
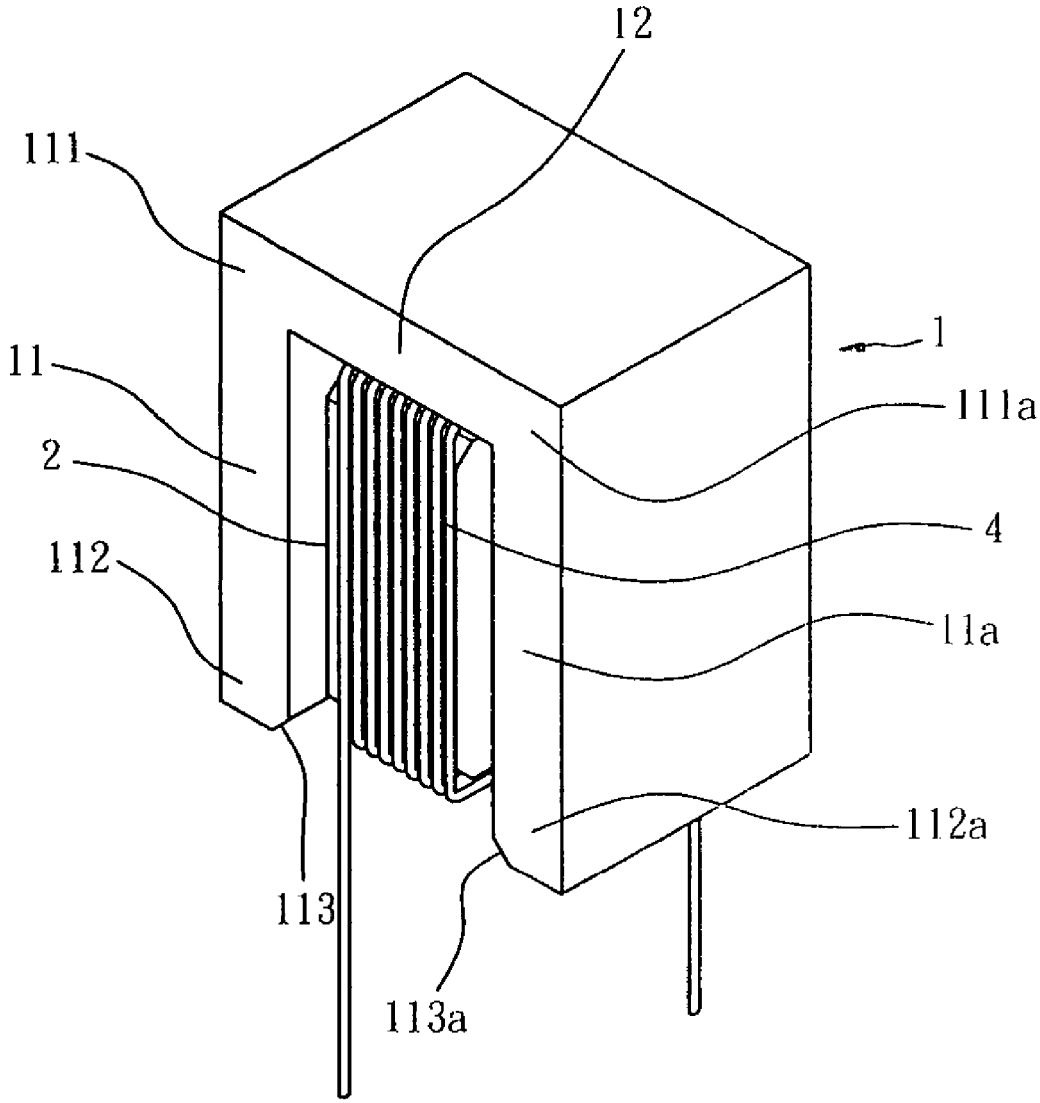
FIG. 5 is a schematic isometric view of the improved structure of inductor of the preferred embodiment of the invention.

FIG. 4 is a schematic exploded view of the improved structure of inductor of the preferred embodiment of the invention; and FIG. 5 is a schematic isometric view of the improved structure of inductor of the preferred embodiment of the invention. As shown in FIG. 4 and FIG. 5, the improved structure of inductor of the invention includes a C-shaped core (1) and a prismatic strut core (2). The C-shaped core (1) is made by integrated forming to protect the C-shaped core (1) from being generating gaps that will cause magnetic flux leakage. This can effectively lower the electromagnetic-wave interference (EMI) resulted from the magnetic flux leakage.

The C-shaped core (1) is equipped with two extended portions (11) and (11*a*) as well as a side portion (12). The two ends of the extended portions (11) and (11*a*) are a fixed end (111) and (111*a*) as well as a free end (112) and (112*a*) respectively. The side portion (12) is connected to the fixed end (111) and (111*a*) of the extended portions (11) and (11*a*) while the free ends (112) and (112*a*) of the extended portions (11) and (11*a*) have a chamfer (113) and (113*a*) respectively. Moreover, the chamfer (113) and (113*a*) that are mutually correspondingly forming is capable of facilitating the insertion of the prismatic strut core (2) without scrapping the surfaces of both the C-shaped core (1) and the prismatic strut core (2).

The prismatic strut core (2) has a bottom surface (21) and a corresponding top surface (21*a*) that are parallel and opposite each other. The prismatic strut core (2) also has a number of side surfaces (22) that are positioned between the bottom surface (21) and the top surface (21*a*), in this preferred embodiment of the invention, the prismatic strut core (2) shown in FIG. 4 has four "side surfaces (22)". Other possible embodiments of the invention (not shown in the FIG.) would show that there are at least 3 side surfaces (22), that is to say that the prismatic strut core (2) can have 3, 4, 5, 6, - - - etc. of side surfaces (22). The prismatic strut core (2) is inserted and placed between the two extended portions (11) and (11*a*) and is having its bottom surface (21) and top surface (21*a*) press against the extended portions (11) and (11*a*) of the C-shaped core (1). The prismatic strut core (2) having the side surfaces (22) connected to the bottom surface (21) and the top surface (21*a*) has chamfers (23) between the bottom surface (21) and top surface (21*a*) at each of the two adjacent side surfaces (22). Therefore, when it comes to winding the coil (4) around the side surfaces (22) of the prismatic strut core (2), the chamfers (23) are capable of preventing the paint-coated surface of the outer layer of the coil (4) and the side surfaces (22) of the prismatic strut core (2) from being worn out. This is because that the worn out surfaces of the paint-coated coil (4) and the side surfaces (22) of the prismatic strut core (2) will affect the insulation or other electrical characteristics. Finally, a fast and simplified fabrication process of inductor is formed by gluing the coil (4) to the side portion (12).

It will become apparent to those people skilled in the art that various modifications and variations can be made to the structure of the invention without departing from the scope or spirit of the invention. In view of the foregoing description, it is intended that all the modifications and variation fall within the scope of the following appended claims and their equivalents.

What is claimed is:

1. An improved structure of inductor comprising:

a C-shaped core having two extended portions and a side portion that is connected to a fixed end of each of the two extended portions; and a prismatic strut core having a bottom surface, a top surface and a number of side surfaces has a coil winding there-around and closely pressing against the side portion of the C-shaped core, and the prismatic strut core is inserted and placed between the two extended portions of the C-shaped core;

wherein between each of the two adjacent side surfaces of the prismatic strut core has a chamfer;

wherein a free end at each of the two extended portions has a chamfer, and the two chamfers are mutually opposite.

2. The improved structure of inductor as claimed in claim 1, wherein the prismatic strut core has a bottom surface and a top surface that are mutually opposite and are pressed against the extended portions of the C-shaped core.

3. The improved structure of inductor as claimed in claim 1, wherein the coil is glued to the side portion by adhesive.

4. The improved structure of inductor as claimed in claim 1, wherein the C-shaped core is made by integrated forming.

* * * * *